US005245145A

United States Patent [19]

Freeman et al.

[11] Patent Number: 5,245,145

[45] Date of Patent: Sep. 14, 1993

[54] MODULAR CLOSING RESISTOR

[75] Inventors: Willie B. Freeman, Irwin, Pa.; Klaus Froelich, Baden, Switzerland; David S. Johnson, Greensburg, Pa.

[73] Assignee: ABB Power T&D Company Inc., Blue Bell, Pa.

[21] Appl. No.: 734,475

[22] Filed: Jul. 23, 1991

[51] Int. Cl.[5] ..... H01H 33/16

[52] U.S. Cl. ..... 200/144 AP; 238/20; 200/148 A

[58] Field of Search ..... 338/21, 20; 361/115, 361/117, 126, 127, 3; 200/144 AP, 148 A, 149 R, 149 B

[56] References Cited

U.S. PATENT DOCUMENTS

| | | | |
|---|---|---|---|
| 3,590,186 | 6/1971 | Brunner | 200/144 AP |
| 3,674,959 | 7/1972 | Clark | 200/144 AP |
| 4,069,406 | 1/1978 | Meinders | 200/144 AP |
| 4,263,490 | 4/1981 | Pham Van | 200/144 AP |
| 4,306,263 | 12/1981 | Gray et al. | 200/144 AP X |
| 4,510,359 | 4/1985 | deCalvino y Teijeiro | 200/144 AP |

*Primary Examiner*—Marvin M. Lateef

*Attorney, Agent, or Firm*—Ostrolenk, Faber, Gerb & Soffen

[57] ABSTRACT

A modular closing resistor assembly can be added in line with the interrupter assemblies of an extra high voltage circuit breaker and has a relatively short length. The resistor element consists of two stacks of disks which are disposed side by side and are electrically connected such that the alternate disks of each stack are connected in series with one another. The operating mechanism of the unit includes a linearly moving roller which engages a crank arm which is in turn pivotally connected to operate the movable closing resistor contact with a motion and with a variable mechanical advantage adapted to cause the resistor contacts to close at high speed just after the interrupter contacts close and to open after the interrupter contacts open.

14 Claims, 5 Drawing Sheets

MODULAR CLOSING RESISTOR

BACKGROUND OF THE INVENTION

This invention relates to extra high voltage circuit breakers and more specifically relates to a novel closing resistor module which can be easily installed within the interior of the housing of an extra high voltage circuit breaker.

Extra high voltage circuit breakers are well known and may be rated at voltages such as 362 kilovolts or 550 kilovolts. A common construction for an extra high voltage circuit breaker employs an outer housing which may be grounded (a dead tank) which has insulator bushings entering the tank at two spaced locations along its length. One or more modular interrupter assemblies supported in series are then connected between the interior portions of the insulating bushings.

It is common in such extra high voltage circuit breakers to employ a closing resistor since switching surges may be more severe than lightning overvoltages. Prior art closing resistors consist of a stack of resistor disks or other elements in parallel with each of the interrupter breaks. The resistor contacts close before the interrupter contacts to pre-insert the resistor in the circuit. The main contacts close later to short circuit the closing resistor. The resistor contact is thereafter opened to remove the resistor from the circuit prior to reopening the interrupter contacts. The closing resistor reduces switching surge overvoltages on the line which otherwise might exceed the lightning basic insulation rating of the device.

Closing resistors are commonly located physically adjacent and coextensive with the interrupter assembly or are located elsewhere within the circuit breaker housing. Closing resistors are frequently quite long, for example, two meters long for a 550 kv circuit breaker. Thus closing resistors and their contacts are not easily mounted within the breaker housing. Moreover, it is not easy to treat the resistor as an add-on option in the design and production of the breaker.

Another problem with closing resistor assemblies in the prior art is that relatively complex operating mechanisms have been needed to cause the closing resistor contacts to close just prior to the interrupter contacts and with high speed and to open before the interrupter contacts open. Thus, complex linkages have been required in the operating mechanisms of the closing resistors. This has further complicated the main operating mechanism of the circuit breaker.

BRIEF DESCRIPTION OF THE INVENTION

In accordance with the present invention, a single closing resistor assembly is made in module form which can be located coaxially within an elongated circuit breaker housing and in line with one or more interrupter assemblies. The physical length of the closing resistor assembly is reduced by dividing the stack of resistor disks into two adjacent and coextensive stacks, each having one half the length of the full stack. The individual disks of the two stacks are then interconnected by a connection which weaves back and forth between the two stacks to connect alternate disks of the stacks in series with one another and in series with two end terminals of the two stacks which terminals are connected in series with the interrupters in the breaker and between the insulation bushings. The novel assembly can then be added to any circuit breaker, as an add-on option if desired, simply by making the tank longer. However, the increased tank length is minimized by the reduced resistor length.

The use of two parallel stacks appears to provide the optimized configuration for the most common tank design and diameter. It is possible to use three or more parallel stacks. This shortens the stack length, but also increases tank diameter.

A novel circuit arrangement and sequence of contact operation is also used since a single resistor is employed for all interrupter breaks. Thus, the modular resistor is connected in series with the interrupter breaks and a pair of resistor contacts is connected in parallel with the resistor. The resistor contacts are closed to short circuit the stack of resistor disks shortly after the closing of the interrupter contacts, permitting several milliseconds of resistor insertion time. During opening of the circuit breaker, the resistor contacts are arranged to open only after the opening of the interrupter contacts so that the resistor contacts are not exposed to interruption arcing duty.

A novel simple operating mechanism is also provided for the movable contact of the novel closing resistor assembly wherein a simple crank arm has a fixed central pivot and its end is connected to the movable contact of the closing resistor. A side edge of the crank arm is engaged by a roller extension from the interrupter contact operating rod. When the main operating mechanism of the breaker operates, it moves the operating rod linearly along its axis. The angle between the line of movement of the roller and the crank arm is small when the resistor contact is fully open, preferably about 20°, creating a low initial mechanical advantage for the linkage. Thus, the roller rides on the crank arm of the resistor assembly to rotate the crank arm slowly at first, so that the interrupter contacts which move more quickly will close before the resistor contacts close. As the crank arm rotates, the mechanical advantage increases. Thus, the resistor contacts subsequently close at very high speed minimizing prestrike arcing.

When the interrupter contact is moved to its open position the operating rod moves in an opposite direction, and a biasing spring within the resistor contact assembly rotates the crank arm after or behind the retreating roller to cause the resistor contacts to open only after the main interrupter contacts open.

The crank arm provides an increasing mechanical advantage lever or crank arm to closely approximate the ideal motion for the resistor contacts. The direct drive also ensures very consistent closing time for the resistor contact with respect to the interrupter contacts.

The novel assembly of the invention is easily adapted to mounting within any circuit breaker design and places minimal design restrictions on the housing the operating mechanism, the interrupters and their support structure and permits easy maintenance since the entire resistor module can be removed from the circuit breaker as a subassembly.

Other features and advantages of the present invention will become apparent from the following description of the invention which refers to the accompanying drawings.

DETAILED DESCRIPTION OF THE DRAWINGS

Figure 1:
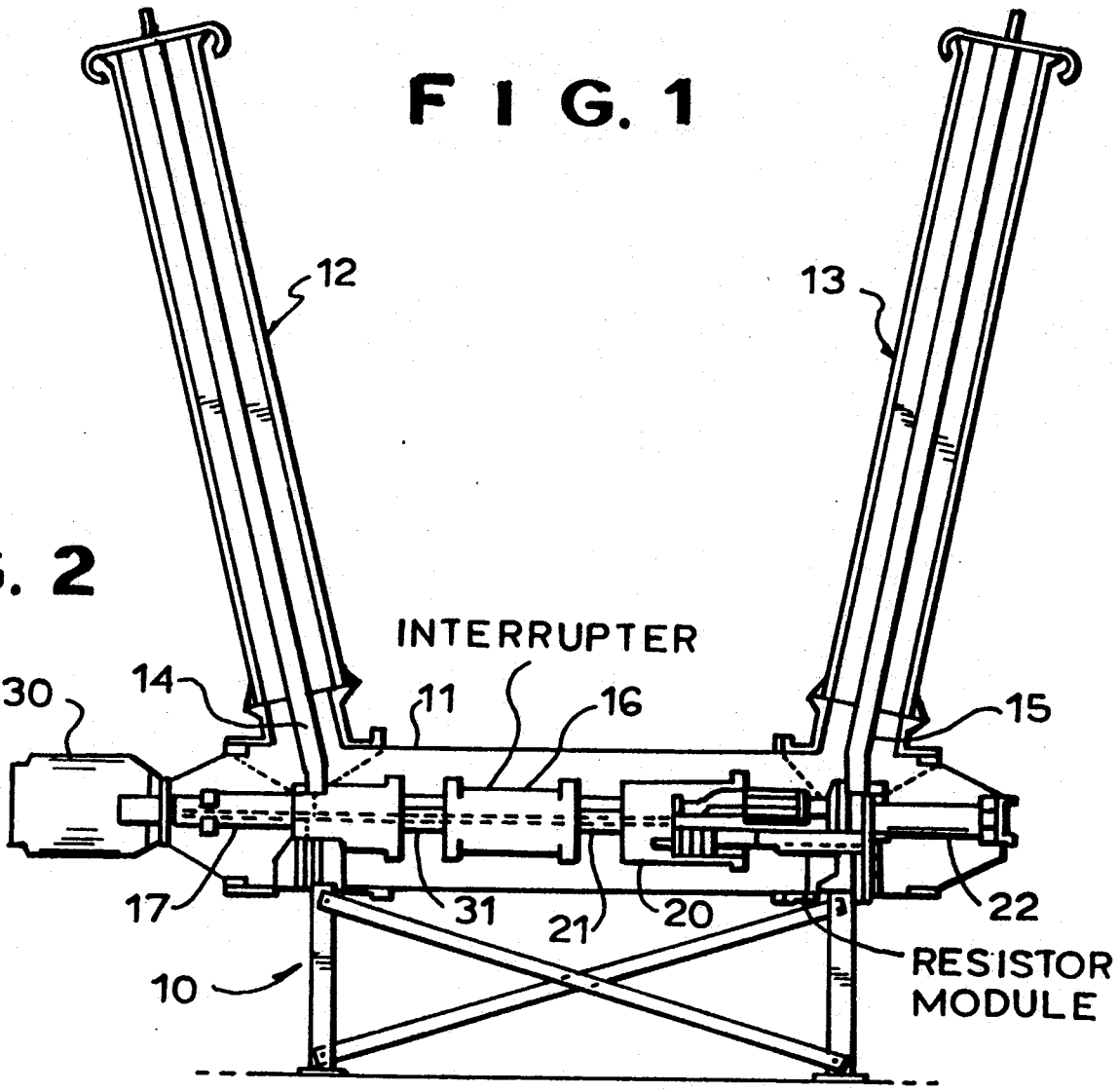
FIG. 1 is a schematic view of a single extra high voltage circuit breaker pole which employs the novel resistor module of the invention.
Figure 2:
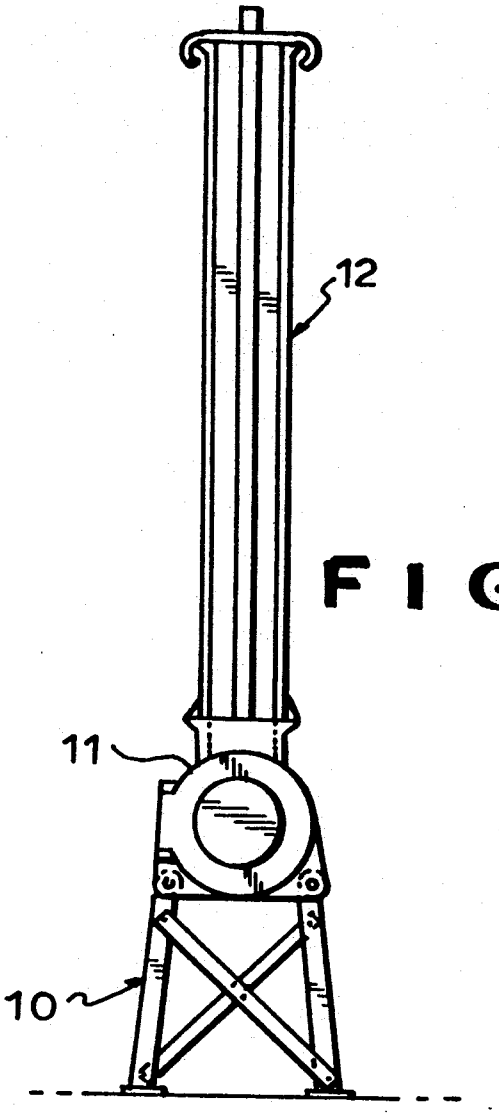
FIG. 2 is an end view of FIG. 1.

Referring first to FIGS. 1 and 2 there is shown therein a single circuit breaker pole for an extra high voltage circuit breaker for example one rated at 550,000 volts. The single breaker pole shown has a support structure 10 and an elongated main tank 11 which may be filled with an insulation gas such as sulphur hexafluoride. Two insulator bushings 12 and 13 of standard design are fixed to the opposite ends of the elongated tank 11. The central conductors 14 and 15 of bushings 12 and 13 respectively enter the interior of the tank 11.

Conventional interrupter assemblies are contained within the interior of the tank 11. FIG. 1 shows a single such interrupter 16 which is of conventional design. Any desired mounting structure including insulation mounting tube 17 can be employed to suspend the interrupter 16 within the interior of the interrupter and generally coaxially with the axis of housing 11. The left hand of interrupter 16 is appropriately electrically connected to the conductor 14 of bushing 12.

In accordance with the present invention a novel resistor module 20 is physically disposed coaxially with and in series with the interrupter 16. One end of module 20 is supported by the conductor 21 which physically connects the left hand end of module 20 to the right hand end of interrupter 16 and extends between appropriate terminals for these two units. The right hand end of assembly 20 is connected to the conductor 15 of bushing 13. Assembly 20 is also connected to an insulation tube 22 for physically fixing the right hand end of module 20 to the end wall of the tank 11.

An operating mechanism 30 is then disposed at the left hand end of the pole shown in FIG. 1. An operating shaft schematically illustrated by the shaft 31 is linearly moved with the interrupter contacts by this operating mechanism. Shaft 31 is also employed for moving the contacts of interrupter 16 and the contacts of the resistor module 20 which will be next described in detail.

Figure 3:
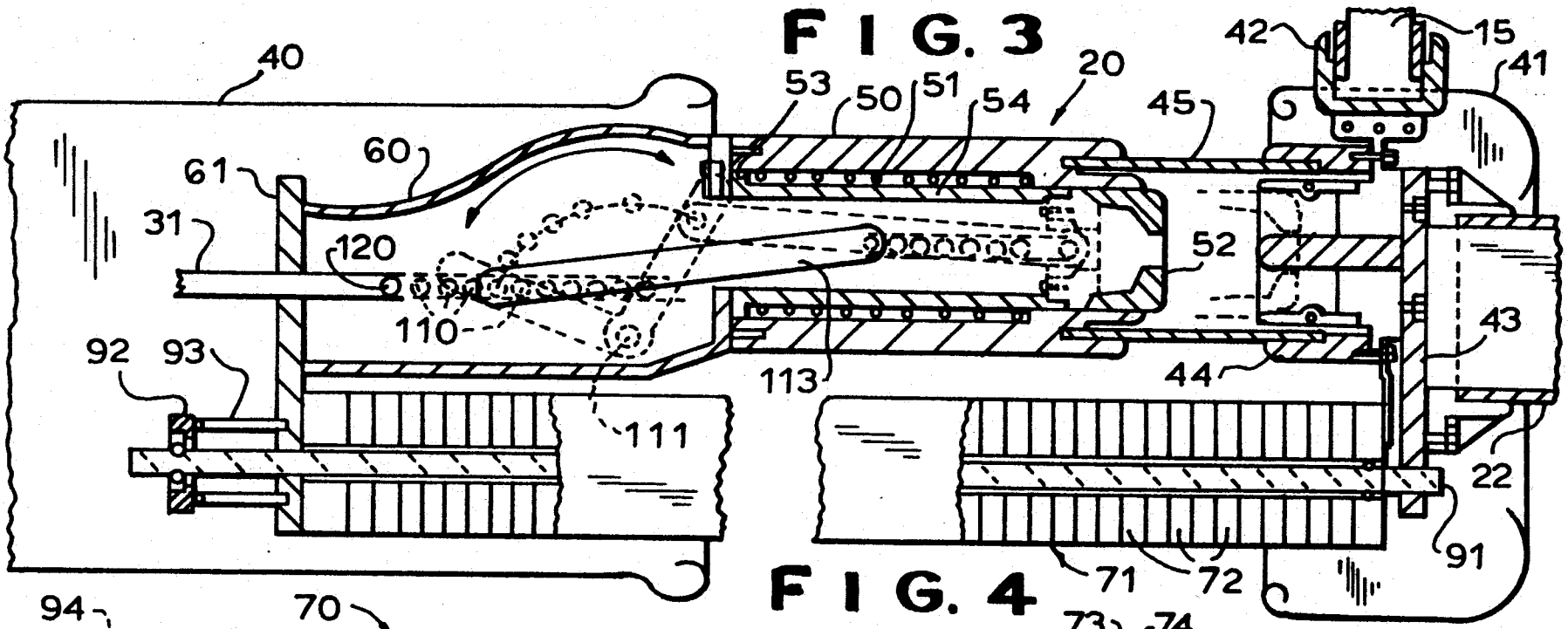
FIG. 3 is a schematic view partially in cross-section of the novel resistor module assembly of FIG. 1.
Figure 4:
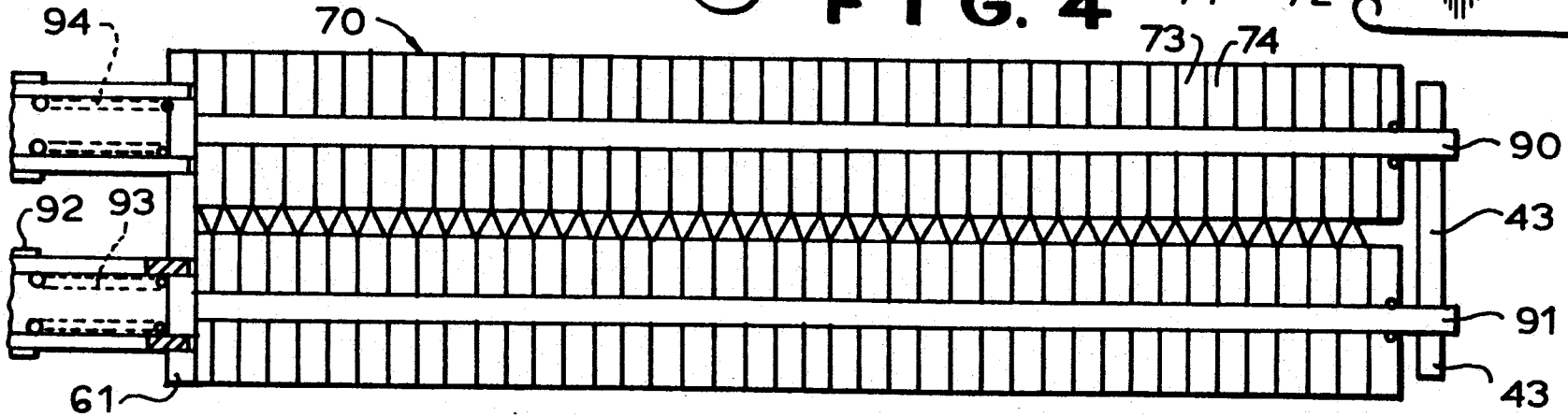
FIG. 4 is a partially schematic view of the resistor stack of FIG. 3 as seen from the bottom of FIG. 3 showing the dual nature of the resistor stack.

The interior of module 20 is shown in detail in FIGS. 3 and 4. The module has an exterior housing which can be of any suitable structure and contains a left hand stationary conductive shield 40 and a right hand corona shield 41 of generally well known design. The end of the bushing conductor 15 is shown at the upper right of FIG. 3 and is connected to the conductive bracket 42 of housing 20. The bracket 42 is in turn connected to the end plate 43 and the stationary contact 44 the closing resistor. A tube 22 is appropriately fixed to plate 43 as is the stationary contact 44. An insulation tube 45 is fixed between stationary contact 44 and contact support 50 of the movable closing resistor contact assembly. The movable closing resistor contact includes an elongated tubular portion 51 and contact portion 52. The tube 51 has a flange 53 at its left hand end which captures a compression spring 54 between cylinder 50 and flange 53 which biases the movable contact assembly to the left and to the position shown in FIG. 3. The left hand end of movable contact support 50 is then secured to a stationary conductive housing 60 which is in turn connected to the end plate 61. The end plate 61 is then electrically connected to the tube 21 (FIG. 1) which connects the movable contact 52 to the right hand end of interrupter 16. Note that a sliding connection exists between the stationary member 50 and the contact tube 51 and contact 52 so that these components are electrically connected in any position of the movable contact 52.

Figure 9:
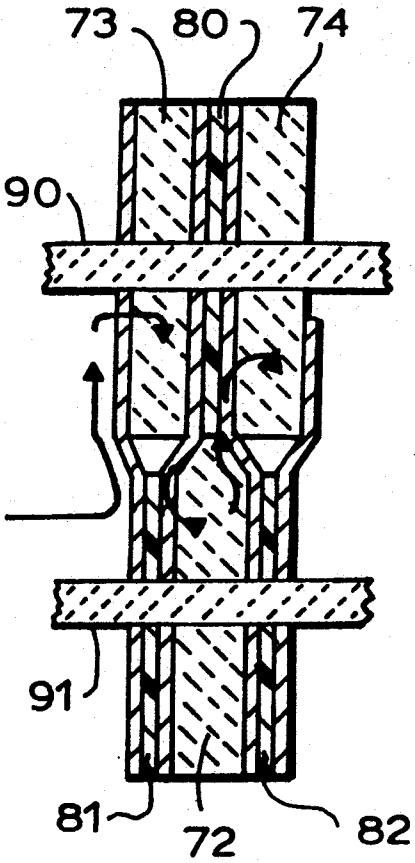
FIG. 9 is cross-sectional view showing the interconnection of three of the disks in the disk stacks of FIG. 4.
Figure 6:
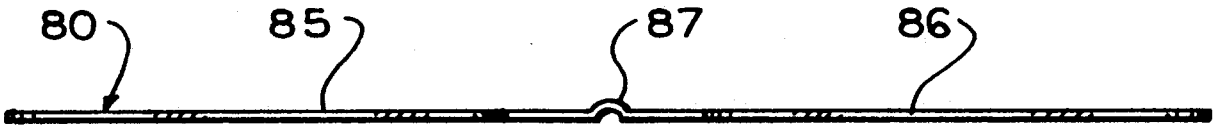
FIG. 6 is a bottom view of the copper interconnect of FIG. 5.

A stack of resistor disks is then connected in parallel with the resistor contact break and between plates 43 and 61 respectively. As best shown in FIGS. 3 and 4, the novel resistor stack consists of two stacks 70 and 71 in FIG. 4 of equal length. Each of stacks 70 and 71 consists of identical resistor disks, typically disks 72, 73 and 74, shown in FIG. 9. FIG. 9 shows several of the disks of adjacent stacks interconnected to one another by contact jumpers such as those of FIG. 6 as will be later described in more detail.

Each of the disks of each stack 70 and 71 may typically consist of conventional one inch thick disks which have a diameter, for example, of six inches for a 550 kv device or five inches for a 360 kv device. These disks are rated to operate at about 13 kv per disk when immersed in sulphur hexafluoride.

Figure 5:
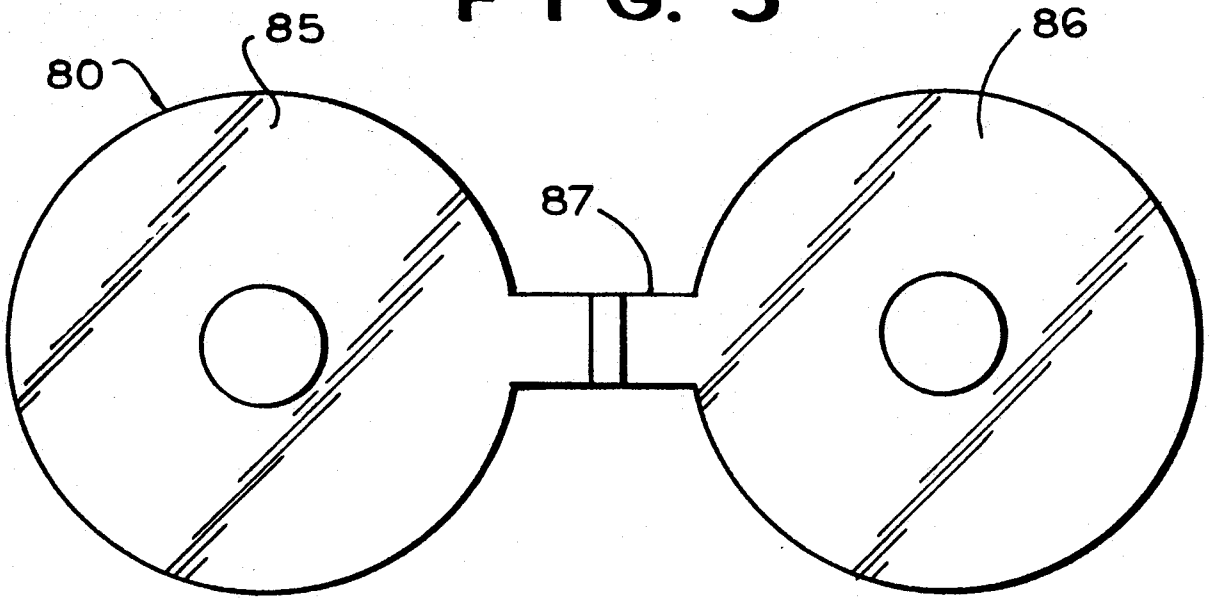
FIG. 5 is a plan view of one copper interconnect which is used to interconnect alternate disks of the two resistor stacks of FIG. 4.

The disks of the stack of disks are separated from one another, as best shown in FIG. 9 by insulation disks 80, 81 and 82 which may be Teflon having a thickness of about 0.090 inches. The opposite surfaces of the insulation disks 80, 81 and 82 receive one disk of the dual disk contact jumper shown in FIGS. 5 and 6 which is made of copper sheet having a thickness of about 0.032 inches. Each of the jumpers such as the jumper 80 shown in FIGS. 5 and 6 have two circular sections 85 and 86 joined by a thin bridge 87 which may be prebent to define a bend region for the disk.

Such contact jumpers are then disposed on either side of the insulation disks 80, 81 and 82 as shown in FIG. 9 and extend from the contact surface of a disk of one of the stacks 70 or 71 to the surface of an adjacent disk. Consequently, a current path is defined along stacks 70 and 71 which alternates from the disk of one stack to the disk of the adjacent stack with each disk of each stack connected in series between its ends.

Each of the disks of stacks 70 and 71 and each of the insulation spacers and contact jumpers have aligned central openings which receive fiberglass tie rods 90 and 91, respectively, shown, for example, in FIGS. 4 and 9. The right hand ends of the tie rods are fixed to mounting plate 43 and extend through the aligned openings of the disks to contact jumpers and the insulation disks. The left hand ends of the tie rods 90 and 91 terminate in support caps such as the cap 92 shown in FIG. 3. The cap 92 is spaced from plate 61 and a compression spring 93 is disposed between cap 92 and plate 61 to exert a compressive force against the resistor disk stack 71 to hold it strongly in compression. A similar compression spring 94 and a similar mounting arrangement holds the stack 70 in compression.

The novel construction shown in FIGS. 3 and 4 for the resistor stack enables a resistor stack which otherwise may be as long as two meters to be reduced in length by half, to only one meter thus making it much easier for mounting within the circuit breaker housing while maintaining all of the desired characteristics for the closing resistor. The relatively short resistor module provides the full resistance of the two series stacks 70 and 71 in series with the interrupter contacts within interrupter assembly 16 when resistor contacts 52 and 44 are open. However, once the contacts 52 and 44 are closed to the dotted line position as shown in FIG. 3 the resistor stacks 70 and 71 are short circuited and removed from the current path through the circuit breaker.

A novel operating mechanism is also provided for the resistor module as is best shown in FIG. 3. This operating module includes a crank arm 110 pivotally mounted on the fixed pivot 111 secured to the housing portion 60. The crank is shown in a solid line position, corresponding to the full open position for the resistor contacts, and in a dotted line, contact-open position. Crank 110 has its outer end pivotally connected to the drive link 113. The other end of drive link 113 is pivotally mounted in turn to the contact tube 51 at its right hand end. The left hand surface of crank arm 110 is oriented so as to intersect a roller 120 carried on the operating shaft 31. Consequently, when shaft 31 moves to the right in order to close the interrupter, roller 120 will roll along the bottom surface of crank 110 thus rotating the crank arm 110 in a clockwise direction. The rotation of the crank arm 110 then drives link 113 to the right so that the movable contact tube 51 similarly moves to the right and moves the movable contact 52 into sliding engagement with the stationary contact 44.

By appropriately adjusting the angle of crank arm 110 to the axis of shaft 31, the mechanical advantage between the motion of roller 120 and motion of contact 52 can be controlled. Good results have been obtained when this "angle of attack" is about 20 degrees, as shown in the solid line position of crank 110, and about 110 degrees in the dotted line position.

When the tube 51 moves to the right it compresses spring 54. Consequently, when the interrupter 16 is to be opened the operating rod 31 moves to the left so that the compression spring 54 now drives the tube 51 to the left as the retreating roller 120 permits counterclockwise rotation of the crank arm 110. This novel simple mechanism can, by appropriate adjustment of the lengths of the various links and the total motion of operating rod 31 between the interrupter open and closed positions, be tailored to produce the most desirable opening and closing travel curves for the movable contact 52.

Figure 7:
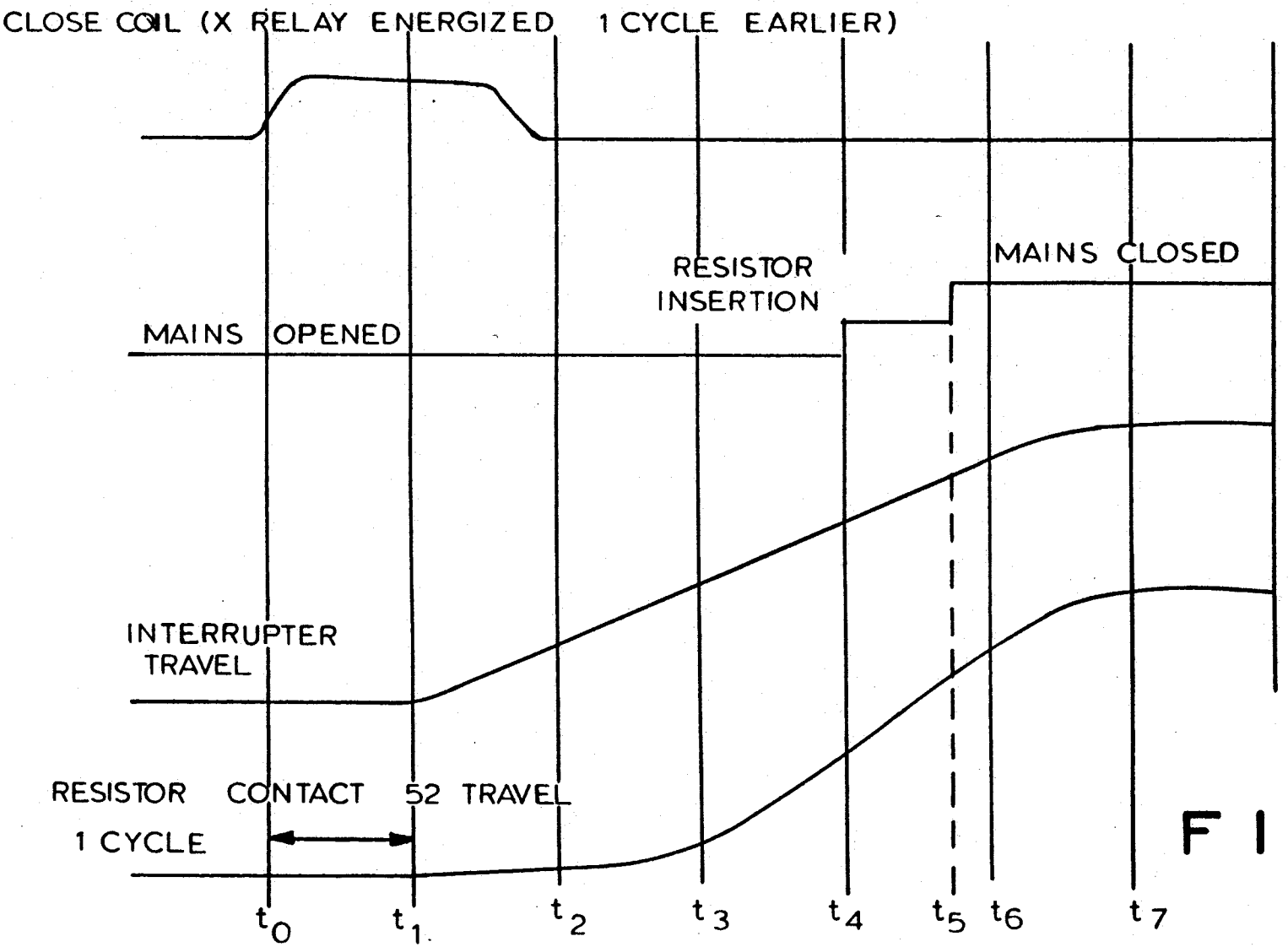
FIG. 7 shows a typical closing travel curve for the movable interrupter contact and movable resistor contact of the circuit breaker of FIGS. 1 and 2.

FIG. 7 shows a typical closing travel curve and interrelates resistor contact 52 travel with the travel of the interrupter contact for a conventional, well-known interruptor circuit. The upper curve in FIG. 7 illustrates the signal on the closing coil which initiates a closing operation. The second curve shows the condition of the main contacts of the interruptor, the third curve shows the interrupter contact travel and the fourth shows the resistor contact travel. At time $t_0$ in FIG. 7 the closing coil is energized. After about one cycle the interrupter contact begins to move with the operating rod 31 of FIG. 3 beginning to move toward the right at time $t_1$. At time $t_2$ the closing coil energization is completed and the resistor contact 52 begins its movement to the closed position, it being noted that the angle of attack between the line of motion of the roller and the axis of link 114 is a shallow angle, thus producing relatively small rightward motion of contact 52 for a relatively large movement of roller 120. That is, there is an initial small mechanical advantage. Note also that this mechanical advantage changes during the rotation of the crank arm 110. At time $t_4$ the interrupter contacts close and the resistor consisting of stacks 70 and 71 is connected in series with the interrupter contacts of interrupter 16 and the circuit connected to bushings 12 and 13. Note that the resistor contacts 52 and 44 have not yet closed, but their closing speed is increasing.

At time $t_5$ in FIG. 7 the resistor contacts 52 and 44 close at high speed and the resistor is short circuited by the resistor contacts and is removed from the power circuit.

At time $t_6$ the main contacts of the interrupter close and, as operating shaft 31 continues to move to the right, the resistor contacts and interrupter contacts settle fully into their closed position at time $t_7$.

The novel operating mechanism shown in FIG. 4 thus produces an ideal closing travel curve for the resistor contacts and ideal synchronization between the operation of the closing resistor contacts and the interrupter contacts.

Figure 8:
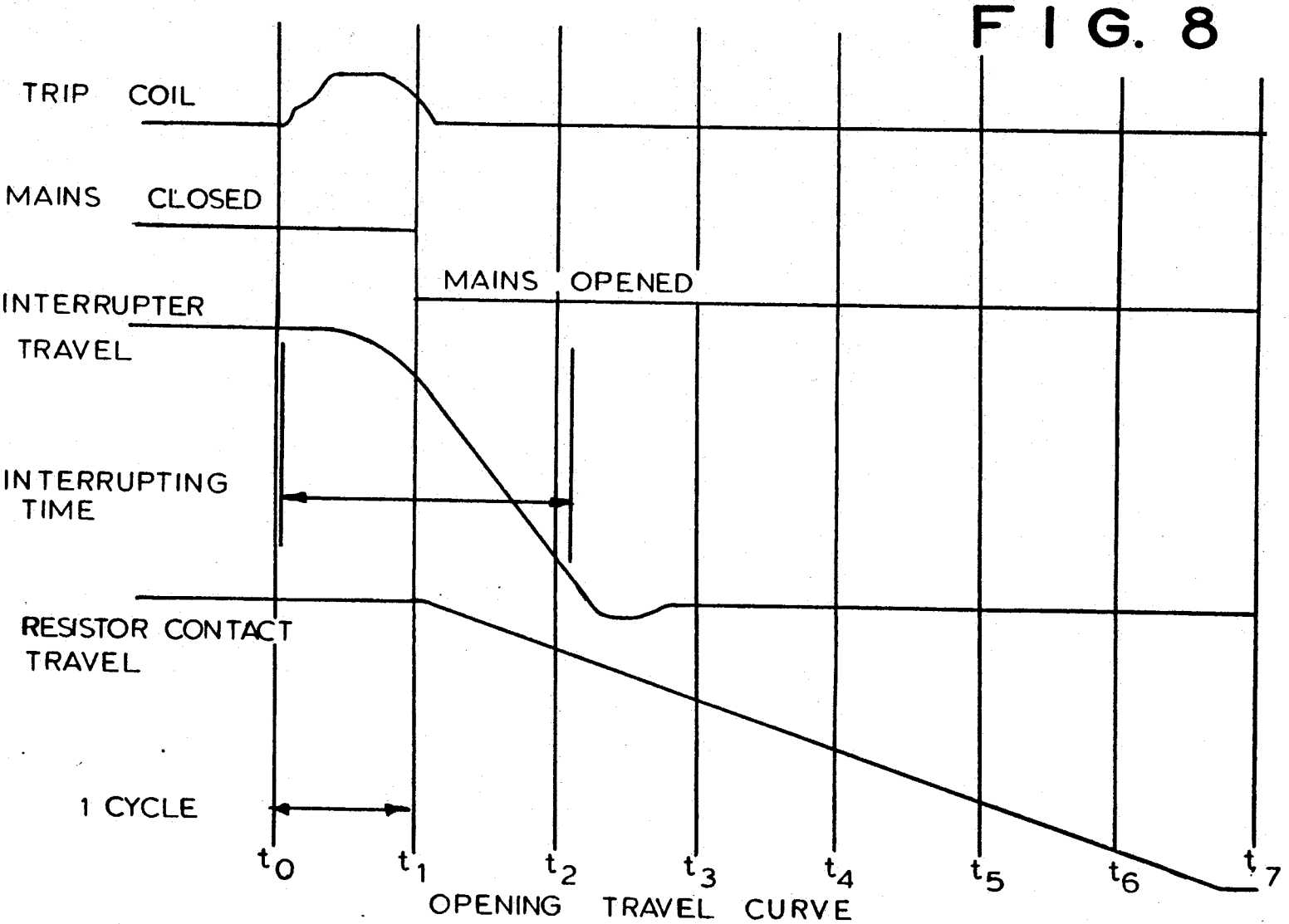
FIG. 8 is an opening travel curve for the movable interrupter contact and movable resistor contact of the circuit breaker of FIG. 2.

FIG. 8 shows the opening travel curve for the mechanism of FIG. 3. Referring now to FIG. 8 at time $t_0$ the trip coil is energized and within about one half cycle the interrupter contact begins to move as the operating shaft 31 begins to move to the left. The interrupter contacts then begin their interrupting action and by time $t_1$, before interruption is completed the main contacts are opened (in parallel with the interruptor contacts) and the resistor contact travel for contact 52 begins to the left in FIG. 3. Just after time $t_2$ interruption is accomplished and resistor contact travel continues to the left until at about time $t_7$ the resistor contact 52 is fully open and the stack resistance is inserted in series with the open interrupter contacts and prepared for the next closing operation.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A modular closing resistor assembly for a circuit interrupter; said modular closing resistor assembly comprising a pair of resistor contacts relatively movable between an open and a closed position and a resistor; a pair of terminals at the opposite ends of said modular closing resistor assembly which are connectable in series with an interrupter assembly; and a first stack and a second stack, each comprising a plurality of resistor disks, said stacks together defining said resistor for said assembly; said first and second stacks of resistor disks being disposed laterally adjacent to one another and being substantially coextensive with one another and being disposed laterally adjacent to said pair of resistor contacts, said disks of said first and second stacks being electrically connected in series with one another in a series circuit which extends between said pair of terminals; said pair of resistor contacts being connected to respective ones of said pair of terminals.

2. The modular closing resistor of claim 1 wherein said pair of resistor contacts and said first and second stacks are fixed together as a subassembly which can be mounted as a unit within an interrupter housing.

3. The modular closing resistor of claim 1 wherein said disks of said first and second stacks are alternately connected to one another to form a series chain of disks.

4. The modular closing resistor of claim 3 wherein each of said disks of each of said stacks are separated from adjacent disks by respective insulation spacers and first and second connector pairs disposed over the opposite surfaces of each of said insulation spacers; said first and second conductor pairs of any given disk being interconnected to the corresponding first and second conductor pairs of a disk of the adjacent stack of said first and second stacks.

5. The modular closing resistor of claim 4 wherein said pair of resistor contacts and said first and second stacks are fixed together as a subassembly which can be mounted as a unit within an interrupter housing.

6. A circuit interrupter comprising, in combination, at least one modular interrupter assembly elongated along an axis, at least one modular closing resistor assembly elongated along an axis, a housing elongated along an axis, and at least one pair of insulation bushings for said housing; said modular interrupter assembly and said modular closing resistor assembly being generally coaxial with the axis of said housing and having adjacent ends thereof connected together and the opposite ends thereof connected to respective ones of said pair of insulation bushings.

7. A circuit interrupter comprising, in combination, at least one modular interrupter assembly elongated along an axis, at least one modular closing resistor assembly elongated along an axis, a housing elongated along an axis, and at least one pair of insulation bushings for said housing; said modular interrupter assembly and said modular closing resistor assembly being generally coaxial with the axis of said housing and having adjacent ends thereof connected together and the opposite ends thereof connected to respective ones of said pair of insulation bushings, said modular closing resistor assembly comprising a pair of resistor contacts relatively movable between an open and a closed position; a pair of terminals at its opposite ends which are connectable in series with an interrupter assembly; and a first stack and a second stack, each comprising a plurality of resistor disks, said stacks together defining a closing resistor; said first and second stacks of resistor disks being disposed laterally adjacent to one another and being substantially coextensive with one another and being disposed laterally adjacent to said pair of resistor contacts, said disks of said first and second stacks being electrically connected in series with one another in a series circuit which extends between said pair of terminals; said pair of resistor contacts being connected to respective ones of said pair of terminals.

8. The circuit interruptor of claim 7 wherein said disks of each of said first and second stacks are alternately connected to one another to form a series chain of disks.

9. The circuit interruptor of claim 8 wherein each of said disks of each of said stacks are separated from adjacent disks by respective insulation spacers and first and second connector pairs disposed over the opposed surfaces of each of said insulation spacers; said first and second conductor pairs of any given disk being interconnected to the corresponding first and second conductor pairs of a disk of the adjacent stack of said first and second stacks.

10. A circuit interrupter comprising, in combination, at least one modular interrupter assembly elongated along an axis, at least one modular closing resistor assembly elongated along an axis, a housing elongated along an axis, and at least one pair of insulation bushings for said housing; said modular interrupter assembly and said modular closing resistor assembly being generally coaxial with the axis of said housing and having adjacent ends thereof connected together and the opposite ends thereof connected to respective ones of said pair of insulation bushings; said modular closing resistor assembly including stationary contact, a relatively movable contact biased to an open position relative to said stationary contact and axially movable into and out of engagement with said stationary contact; and an operating linkage fixed to said movable contact and comprising a crank arm having a fixed central pivot and rotatable around said fixed central pivot; and an axially movable roller driver fixed to the movable contact of said interrupter; said roller contact engaging a side surface of said crank link which faces away from said fixed central pivot so as to rotate said crank link with a variable mechanical advantage as said interrupter contact is moved between an engaged and disengaged position, whereby said resistor contacts have a closing travel characteristic in which they close after said interrupter contacts close and open before said interrupter contacts open.

11. The circuit interrupter of claim 10 which further includes spring biasing means for biasing said movable contact to an open position and for biasing said crank arm into contact with said movable roller driven in any position of said movable roller driven.

12. The circuit interruptor of claim 6, wherein said modular closing resistor assembly comprises a pair of resistor contacts relatively movable between an open and a closed position and a resistor; a pair of terminals at the opposite ends of said modular closing resistor assembly which are connectable in series with an interrupter assembly; and a first stack and a second stack, each comprising a plurality of resistor disks, said stacks together defining said resistor for said assembly; said first and second stacks of resistor disks being disposed laterally adjacent to one another and being substantially coextensive with one another and being disposed laterally adjacent to said pair of resistor contacts, said disks of said first and second stacks being electrically connected in series with one another in a series circuit which extends between said pair of terminals; said pair of resistor contacts being connected to respective ones of said pair of terminals.

13. The circuit interruptor of claim 12, wherein said modular closing resistor assembly constitutes a unit which can be mounted within and removed from the interruptor housing as a unit.

14. The circuit interruptor of claim 6, wherein said modular closing resistor assembly constitutes a unit which can be mounted within and removed from the interruptor housing as a unit.

* * * * *